United States Patent [19]

Raasch

[11] Patent Number: 4,601,166

[45] Date of Patent: Jul. 22, 1986

[54] SPINNING DEVICE

[76] Inventor: Hans Raasch, Amselstrasse 1,, 4050 Monchen-Gladbach, Fed. Rep. of Germany

[21] Appl. No.: 605,626

[22] Filed: Apr. 30, 1984

[30] Foreign Application Priority Data

Apr. 30, 1983 [DE] Fed. Rep. of Germany ..... 3315777

[51] Int. Cl.[4] ..... D01H 1/135; D01H 7/885

[52] U.S. Cl. ..... 57/401; 57/408

[58] Field of Search ..... 57/400, 404, 401, 406, 57/408, 409

[56] References Cited

U.S. PATENT DOCUMENTS 4,315,398 2/1982 Parker et al. ..... 57/401

4,362,008 12/1982 Parker et al. ..... 57/401

*Primary Examiner*—John Petrakes

*Attorney, Agent, or Firm*—Herbert L. Lerner; Laurence A. Greenberg

[57] ABSTRACT

A spinning device for manufacturing a twisted thread at least partially formed of spinning fibers, includes a perforated drum rotating about a given axis of rotation, a suction device disposed in the drum, the suction device having at least one suction opening formed therein extended substantially parallel to the given axis of rotation, a device disposed outside the drum opposite the suction opening for forming a wedge-shaped area for spinning fibers, a device for conducting flying spinning fibers into the wedge-shaped area, and a device for pulling out a spun thread substantially parallel to the given axis of rotation, the forming device including a shell carrier rotating about a longitudinal axis and a flexible shell disposed on the shell carrier.

14 Claims, 4 Drawing Figures

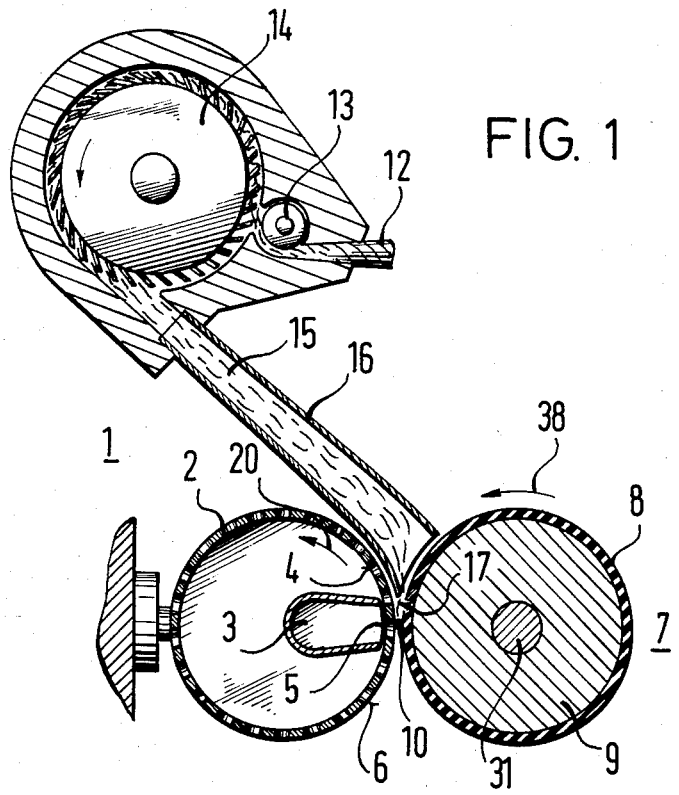
FIG. 1
FIG. 2
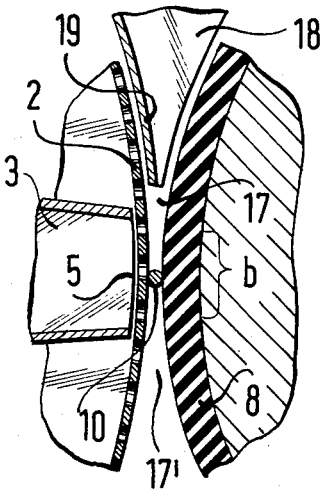

SPINNING DEVICE

The invention relates to a spinning device for manufacturing a twisted thread formed at least partially of spinning fibers, with a rotating perforated drum which has a suction device that is disposed in the interior of the drum and is provided with at least one suction opening running substantially parallel to the axis of the drum, and a wedge former disposed outside the drum opposite to the suction opening, whereby the spinning fibers fly into the wedge, and the spun thread is pulled out approximately parallel to the axis of the drum.

Spinning machines of this type have the disadvantage of producing a spun thread which is not as uniform as desired. This is a special problem when fine yarns are manufactured. Though in thicker yarns the strength of the thread is more important than its uniformity, still the thread loses the required uniform contact with the drum or the element forming the wedge due to eccentricity in the rotation of the perforated drum, so that even in this case the spinning result is unsatisfactory.

It is accordingly an object of the invention to provide a spinning device, which overcomes the hereinaforementioned disadvantages of the heretofore-known devices of this type, to improve the results obtained in the spinning operation, and especially to make it possible to produce very fine yarns by spinning.

With the foregoing and other objects in view there is provided, in accordance with the invention, a spinning device for manufacturing a twisted thread at least partially formed of spinning fibers, comprising a perforated drum rotating about a given axis of rotation, a suction device disposed in the drum, the suction device having at least one suction opening formed therein extended substantially parallel to the given axis of rotation, means disposed outside the drum opposite the suction opening for forming a wedge-shaped area for spinning fibers, means for conducting flying spinning fibers into the wedge-shaped area, and means for pulling out or drawing off a spun thread substantially parallel to the given axis of rotation, the forming means including a shell carrier rotating about a longitudinal axis and a flexible shell disposed on the shell carrier.

The advantages obtained through the use of the invention lie especially in the fact that an excellent spinning result is achieved without extreme requirements for dimensional accuracy, surface quality, concentricity or bearing precision of the perforated drum or of the device forming the wedge.

In accordance with another feature of the invention, the flexible shell is formed of rubber-elastic material.

In accordance with a further feature of the invention, the shell is in the form of a tube which is pulled over the shell carrier, and the tube has ends which are fastened to ends of the shell carrier.

In accordance with an added feature of the invention, the shell carrier is a roller or drum.

In accordance with an additional feature of the invention, the forming means includes a controllable device for pressurizing the interior of the shell.

In accordance with again another feature of the invention, the controllable pressurizing device supplies fluid to the interior of the shell.

In accordance with again a further feature of the invention, the fluid is supplied to a gap between the shell and the shell carrier.

In accordance with again an added feature of the invention, the shell carrier is a fluidic cushion tank.

In accordance with a concomitant feature of the invention, the perforations in the drum face toward the shell.

During the spinning operation the flexible shell is expanded in the direction toward the perforated drum. However, the shell does not at all touch, or only slightly touches, the perforated drum.

Other features which are considered as characteristic for the invention are set forth in the appended claims.

Although the invention is illustrated and described herein as embodied in a spinning device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a fragmentary, diagrammatic, cross-sectional view of the device of the invention;

FIG. 2 is an enlarged view of a portion of the device shown in FIG. 1;

Figure 3:
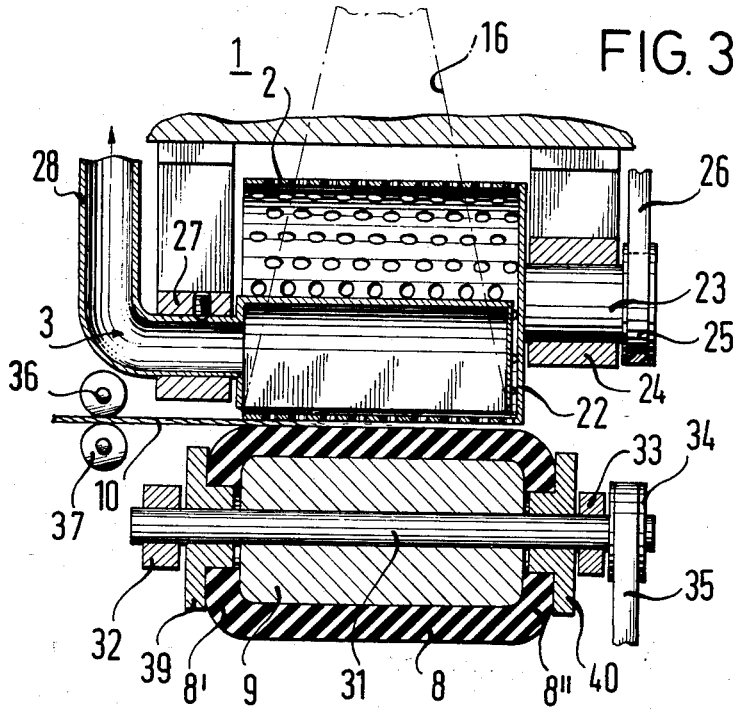
FIG. 3 is a longitudinal-sectional view of the device shown in FIG. 1.

Referring now to the figures of the drawing in detail and first particularly to FIG. 1 thereof, there is seen a spinning device designated as a whole with reference numeral 1, which is provided with a rotating, perforated drum 2 which has a suction device 3 in the interior of the drum 2 provided with a suction opening 5 directed against the inner wall 4 of the drum 2.

A wedge forming apparatus which is designated by reference numeral 7 as a whole, is disposed opposite the suction opening 5 and spaced from the outer wall 6 of the drum 2. In a more narrow sense, the wedge forming apparatus 7 is formed by a rotatable roller or shell carrier 9 which has a resilient or flexible jacket or shell 8. A sliver 12 is gripped by a driven feed or drawing-in roller 13, and is conducted to a needle-carrying loosening or separating roller 14, which has a considerably greater circumferential velocity than the feed roller 13. The loosening or opening roller 14 dissolves or loosens the sliver 12 to form individual fibers 15 which reach a wedge-shaped area 17 through a fiber supply channel 16. The wedge-shaped area 17 is defined or formed by the outer surfaces of the drum 2 and the shell 8, as best seen in FIG. 2. The fiber supply channel 16 is disposed at the entrance of the wedge-shaped area 17 and it discharges into this wedge-shaped area 17. The outlet 18 of the channel 16 is directed against the shell 8. Additionally, the fiber supply channel 16 is provided with an apron 19 at its outlet 18. The apron 19 ends in the wedge 17, and covers the perforated drum 2.

During the spinning operation, the drum 2 rotates in a direction opposite to the direction of the flying spinning fibers 15, as indicated by the arrow 20. The direction of rotation of the roller 9 and therefore of the shell 8 is directed against the direction of rotation of the drum 2.

According to FIG. 3, the perforated drum 2 is open at one end thereof, and at its other end is closed by a cover 22. A shaft 23 is connected to the cover 22, and is supported in a stationary bearing 24. A belt pulley is disposed at the end of the shaft 23, and is set in rotation by a belt 26. The suction device 3 is inserted into the perforated drum 2 from the open end thereof, and is held in its position by a stationary holder 27. A suction line 28 connects the suction device 3 with an external suction pump.

The negative suction pressure at the suction opening 5 of the suction device 3, the width of the suction opening 5, the mechanical tension and elasticity of the shell 8, and the distance between the shell 8 and the drum 2 are adjusted in such a way that during the spinning operation there is no mechanical contact between the drum 2 and the shell 8, but both parts are in contact with a thread 10. As seen in FIG. 2, the suction opening 5 is wider than a region b, which is that part of the shell 8 that acts on the thread 10. In particular, the width of the region b is such that the suction opening 5 covers the ends of the wedge-shaped area 17 as well as a similar area 17'.

FIG. 3 shows especially clearly that the roller 9 sits on a shaft 31 which is supported in bearings 32, 33. At the end of the shaft 41 is a pulley 34 which is caused to rotate by a belt 35, in the direction of the curved arrow 38 seen in FIG. 1, during the spinning operation. The flexible, resilient shell 8 is formed of a rubber-elastic material. The shell 8 is made in the shape of a tube which is pulled over the roller 9. The ends 8', 8'' of the shell 8 are fastened to the end faces of the roller 9. Two flanges 39, 40 are screwed to the roller 9 in order to clamp the ends of the tube 8 against the sides of the roller 9. In this specific embodiment, the cylindrical shell of the roller 9 is not connected by an adhesive or the like with the tube 8. This feature enhances the effectiveness of the device, and thereby it also enhances the spinning results.

The flying spinning fibers 15 in the supply channel 16 enter into the wedge-shaped area 17, and a portion of them also travel onto the shell 8, and from there to a spinning line, where the thread 10 is formed and continuously pulled out by rollers 36, 37.

Figure 4:
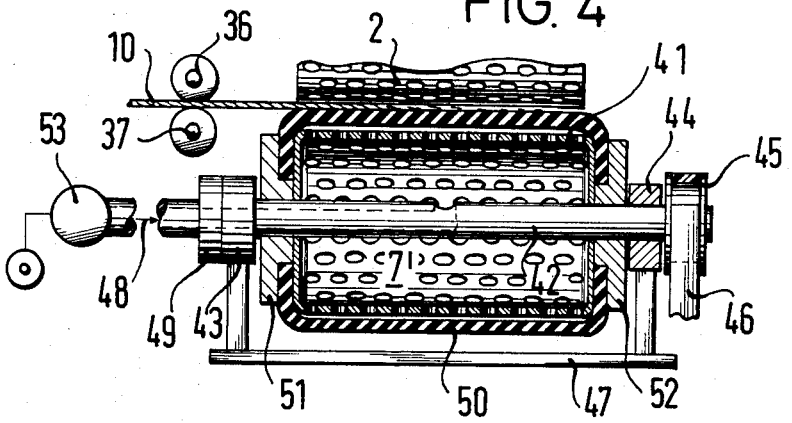
FIG. 4 is a partially cross-sectional view of an alternative embodiment of the invention.

FIG. 4 shows that in the alternate embodiment, the perforated drum 41 of the wedge forming apparatus 7' sits on a shaft 42, which is supported in bearings 43, 44. At one end of the shaft 42 is a pulley 45 which is caused to rotate by a belt 46. The bearings 43, 44 are mounted in a frame 47. The shaft 42 is hollow, so that compressed air can be introduced in the direction of an arrow 48 through a rotatable coupling 49 into a drum or shell carrier 41 which is constructed to act as an air cushion or fluid tank. The air pressure which can be adjusted by a control device 53 lifts the flexible shell 50 somewhat away from the drum 41. The flexible shell 50 is formed of a rubber-like elastic material. The shell 50 is made in the form of a tube which is pulled over the drum 41, and has ends which are fastened to the ends of the drum 41. Two flanges 51, 52 screwed to the drum 41 clamp the ends of the tube 50 against the end surfaces of the drum 41. In this case the pneumatic pressure level determines the outer diamter of the shell, and at the same time it also changes its flexibility. Because of this feature, the spinning device can be adjusted to an even better extent for the desired spinning result.

The invention is not limited to the illustrated and described specific embodiments. If the thread 10 is only formed from the supplied fibers, the result is a simple EO-yarn or thread. However, if a thread or filament is introduced along the friction line during the spinning operation, the resulting yarn or thread is an OE-mantle or coated yarn or thread, formed of a core, and spinning fibers which surround the core thread forming a fiber union or bond with a real twist.

There are exceptional cases, wherein, in contrast to the specific embodiments, it is more advantageous to rotate the perforated drum in the direction in which the fibers are supplied, and to move the wedge forming roller against the direction of the fiber supply. The controllable device for supplying compressed air to the interior of the shell according to the embodiment of FIG. 4, includes a controllable valve in conjunction with a rotatable coupling and a hollow shaft. In this way, the air or fluid pressure can be changed or adjusted during the rotation of the elements forming the wedge-shaped area. In a more simple embodiment a plain shutoff valve or a non-return valve would suffice as an inlet valve. The rotatable coupling could be omitted in this case, and the pressure adjustment would be made while the wedge forming roller is stopped. A drum constructed to act as an air or fluidic cushion can be constructed so that it is a yielding elastic element itself, and can be "pumped up" so to speak.

Other apparatus for supplying pressure to the interior of the shell can be provided, such as mechanical expansion means, or constructions similar to the pneumatic tires of power-propelled vehicles.

I claim:

1. Spinning device for manufacturing a twisted thread at least partially formed of spinning fibers, comprising a perforated drum rotating about a given axis of rotation, a suction device disposed in said drum, said suction device having at least one suction opening formed therein extended substantially parallel to said given axis of rotation, means disposed outside said drum opposite said suction opening for forming a wedge-shaped area for spinning fibers, means for conducting flying spinning fibers into said wedge-shaped area, means for pulling out a spun thread substantially parallel to said given axis of rotation, said wedge-shaped area forming means including a shell carrier rotating about a longitudinal axis and a flexible shell disposed on said shell carrier, and means disposed inside said shell for varying the outside diameter of said flexible shell.

2. Spinning device according to claim 1, wherein said flexible shell is formed of rubber-elastic material.

3. Spinning device according to claim 1, wherein said shell is in the form of a tube which is pulled over said shell carrier, and said tube has ends which are fastened to ends of said shell carrier.

4. Spinning device according to claim 3, wherein said shell carrier is a drum.

5. Spinning device according to claim 1, wherein said wedge-shaped area forming means includes a controllable device for pressurizing the interior of said shell.

6. Spinning device according to claim 5, wherein said controllable pressurizing device supplies fluid to the interior of said shell.

7. Spinning device according to claim 6, wherein said fluid is supplied to a gap between said shell and said shell carrier.

8. Spinning device according to claim 7, wherein said shell carrier is a fluidic tank.

9. Spinning device according to claim 8, wherein said perforations in said drum face toward said shell.

10. Spinning device according to claim 6, wherein said shell carrier is a fluidic tank.

11. Spinning device according to claim 10, wherein said perforations in said drum face toward said shell.

12. Spinning device according to claim 5, wherein said shell carrier is a fluidic tank.

13. Spinning device according to claim 12, wherein said perforations in said drum face toward said shell.

14. Spinning device according to claim 1, wherein said outside diameter varying means are in the form of means for feeding fluid against said flexible shell from inside said flexible shell.

* * * * *